United States Patent [19]

Gallet

[11] Patent Number: 4,817,596

[45] Date of Patent: Apr. 4, 1989

[54] HELMET FOR USE WITH RESPIRATOR MASK

[75] Inventor: Adrien Gallet, Chatillon-sur-Chalaronne, France

[73] Assignee: Gallet S.A., Chatillon-sur-Chalaronne, France

[21] Appl. No.: 529,617

[22] Filed: Sep. 6, 1983

[30] Foreign Application Priority Data

Sep. 3, 1982 [FR] France ..... 82 15389

[51] Int. Cl.[4] ..... A62B 18/00

[52] U.S. Cl. ..... 128/201.24; 128/201.29; 128/201.14

[58] Field of Search ..... 2/5, 410; 24/68 R, 68 SK, 24/71 R, 71 SK, 70 SK, 70 ST, 70 J, 71 ST, 71 J; 128/201.12, 201.14, 201.22–201.26, 201.28, 201.29

[56] References Cited

U.S. PATENT DOCUMENTS

| | | | |
|---|---|---|---|
| 625,573 | 5/1899 | Leavitt | 24/71 A |
| 1,715,153 | 5/1929 | Wallenthin | 24/71 J |
| 1,740,957 | 12/1929 | Phillips | 24/71 A |
| 2,408,279 | 9/1946 | Valcourt | 24/71 J |
| 2,518,551 | 8/1950 | Jaccarino | 24/71 J |
| 2,661,957 | 12/1953 | Attenhofer | 24/68 SK |
| 2,994,934 | 8/1961 | Kraus | 24/71 ST |
| 2,994,935 | 8/1961 | Buchholz | 24/68 SK |
| 3,065,747 | 11/1962 | Forkel | 128/201.24 |
| 3,427,660 | 2/1969 | Raschke | 128/201.23 |
| 3,513,841 | 5/1970 | Seeler | 128/201.23 |
| 3,833,935 | 9/1974 | Ansite et al. | 128/201.24 |
| 4,352,353 | 10/1982 | Bolton et al. | 128/201.23 |

FOREIGN PATENT DOCUMENTS

| | | | |
|---|---|---|---|
| 841652 | 6/1952 | Fed. Rep. of Germany | 24/71 J |
| 2549979 | 5/1977 | Fed. Rep. of Germany | 128/201.24 |
| 1230574 | 4/1902 | France . | |
| 453952 | 6/1968 | Switzerland | 24/71 SK |
| 462515 | 10/1968 | Switzerland | 24/71 J |
| 844060 | 8/1960 | United Kingdom . | |

*Primary Examiner*—Ruth S. Smith

*Attorney, Agent, or Firm*—Herbert Dubno; Andrew Wilford

[57] ABSTRACT

A helmet comprises a rigid shell having right and left sides and formed therebetween with a forwardly open face cutout and therebelow with a downwardly open neck opening, a plurality of interconnected and flexible radius straps having right and left ends converging at respective right and left locations on the sides of the shell, and respective right and left anchor elements on the right and left sides generally at the respective locations. This helmet is generally symmetrical about a vertical plane between the sides and bisecting the cutout and opening. A respirator usable with this helmet has a mask engageable through the face cutout snugly with the face of the wearer of the helmet, respective right and left hooks engageable with the anchor elements and fixed to the mask, and a spring connected between the hooks and the mask for pulling the mask back into the helmet.

8 Claims, 4 Drawing Sheets

HELMET FOR USE WITH RESPIRATOR MASK

FIELD OF THE INVENTION

The present invention relates to a protective helmet. More particularly this invention concerns such a helmet that is specifically usable with a respirator mask.

BACKGROUND OF THE INVENTION

A helmet of the type used by firemen and the police must often be used together with a respirator mask, that is with a face mask provided with appropriate air filters or supplies and having a clear lens in front of the eyes.

Typically the helmet is provided with an interior web assembly that supports its hard outer shell wholly out of contact with the user's head. The respirator has a flexible skirt that must engage snugly against the face of the user and is normally held in place by its own straps for an airtight fit.

Removing the helmet, putting on the respirator, and then donning the helmet again is normally considered inacceptable, particularly in the dangerous environment in which such an assembly is used, and since the helmet does not fit properly over the respirator straps. Specially configuring the mask so it can fit within the face hole of the helmet has been suggested, but no known system allows a respirator mask to fit safely with the whole range of head sizes that the helmet can be used with, and the procedure for attaching and removing the respirator is cumbersome.

OBJECTS OF THE INVENTION

It is therefore an object of the present invention to provide an improved respirator mask and helmet assmebly.

Another object is the provision of such a respirator mask and helmet assembly which overcomes the above-given disadvantages, that is which can fit tightly against the face of any user of the helmet.

SUMMARY OF THE INVENTION

A helmet according to the invention comprises a rigid shell having right and left sides and formed therebetween with a forwardly open face cutout and therebelow with a downwardly open neck opening, a plurality of interconnected and flexible radius straps having right and left ends converging at respective right and left locations on the sides of the shell, and respective right and left anchor elements on the right and left sides generally at the respective locations. This helmet is generally symmetrical about a vertical plane between the sides and bisecting the cutout and opening. A respirator usable with this helmet has a mask engageable through the face cutout snugly with the face of the wearer of the helmet, respective right and left hooks engageable with the anchor elements and fixed to the mask, and a spring connected between the hooks and the mask for pulling the mask back into the helmet.

The provision of the anchors of the mask right at the same location where the straps are attached, or the center of force of the straps, ensures that the mask will always be positioned perfectly and solidly once the helmet is properly fitted to the wearer. The mask will therefore fit tightly and will be quite comfortable, as the network of straps of the helmet will transmit the force to a large area.

According to another feature of this invention the anchor elements are unitary with the respective sides of the shell. They may also be provided with fasteners that secure them to the respective sides of the shell.

Each hook according to the invention comprises a front part pivoted on the mask and a rear part telescoping with the front part. The spring means is a spring connected between the parts. A hook part carried on the rear part is engageable behind the respective anchor element. Each latch element further comprises latch means for holding the front and rear parts apart against the force of the spring means except when the respective hook part is engaged over the respective anchor piece. The hook part and front part carry respective interfitting latch formations constituting the latch means and the hook part is pivotal on the rear part between one position with the formations interfitting and blocking relative displacement of the parts and another position with the formations out of contact with each other. Furthermore in each hook one of the respective front and hook parts is formed with a row of sawteeth engageable with the formation of the other of the respective front and hook parts to block displacement of same away from each other in the other position of the respective hook part, that is the formation can ratchet in one direction over the sawteeth. The hooks are part of the mask, so that when it is not being used the helmet need not have any unnecessary structure.

With this system it is therefore possible to don the mask very rapidly. The user first cocks the arms by pulling out the rear part and hook part of each until they latch. Then the mask is fitted to the wearer's face and the arms are swung in to disengage the latching formations and allow the hook parts to catch on the anchors. When properly seated the sawteeth will prevent unwanted pulling-apart of the telescoping front and rear parts, so that only the user or another person familiar with the operation of the assembly can take off the mask.

Each hook according to this invention is provided with a flexible but inextensible element connected between the respective front and rear parts and limiting displacement of same away from each other. Thus accidental separation of the rear part from the front part of each arm is impossible.

The helmet according to this invention further comprises an annular strap connected to the radial straps and lying in a generally horizontal plane perpendicular to the symmetry plane and a longitudinal strap lying generally in the plane and having ends connected to the annular strap. It may also have a front bumper provided inside the shell above the face cutout, generally bisected by the symmetry plane, and engageable with the forehead of the wearer of the helmet. Thus exact positioning of the shell on the wearer's head is ensured.

The shell in accordance with this invention is double-walled and the helmet further comprises an at least semitransparent lens pivotal on the shell between a down position in front of the upper portion of the face cutout and an up position lying above the face cutout between the walls of the shell, and a transparent face shield pivotal on the shell between a down position in front of the entire face cutout and an up position lying above the face cutout between the walls of the shell. This shield can be formed with a visor that projects forward from above the face cutout in the up position of the shield. In the down position the visor constitutes a throat protector.

DESCRIPTION OF THE DRAWING

The above and other features and advantages will become more readily apparent from the following, reference being made to the accompanying drawing in which.

SPECIFIC DESCRIPTION

Figure 1:
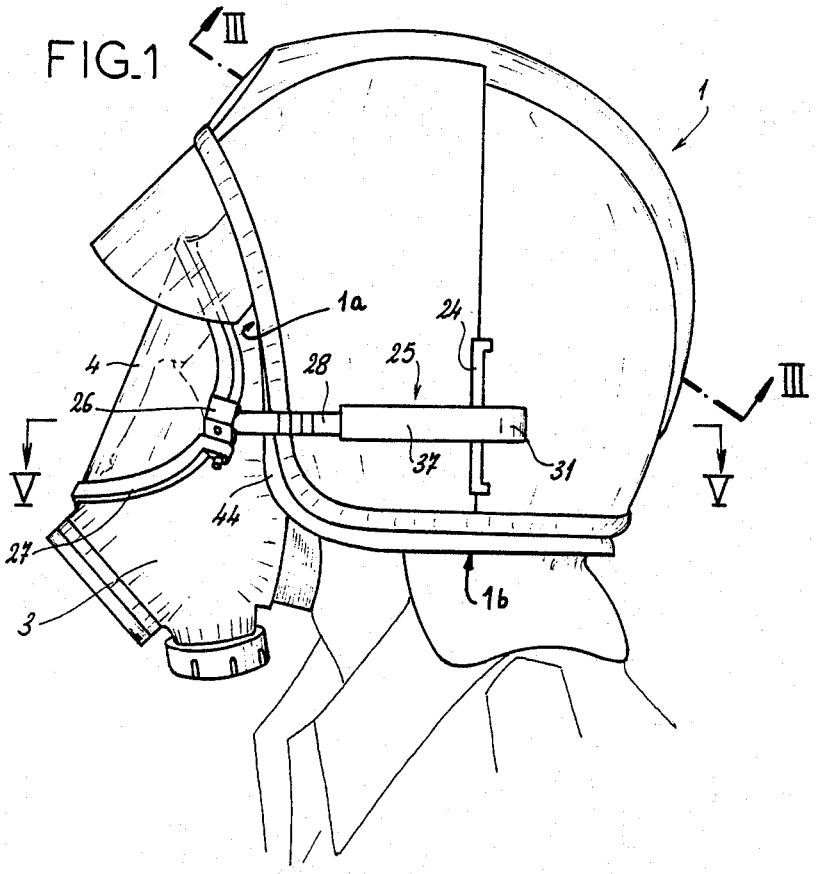
FIG. 1 is a side view of the helmet/respirator assembly according to this invention.
Figure 2:
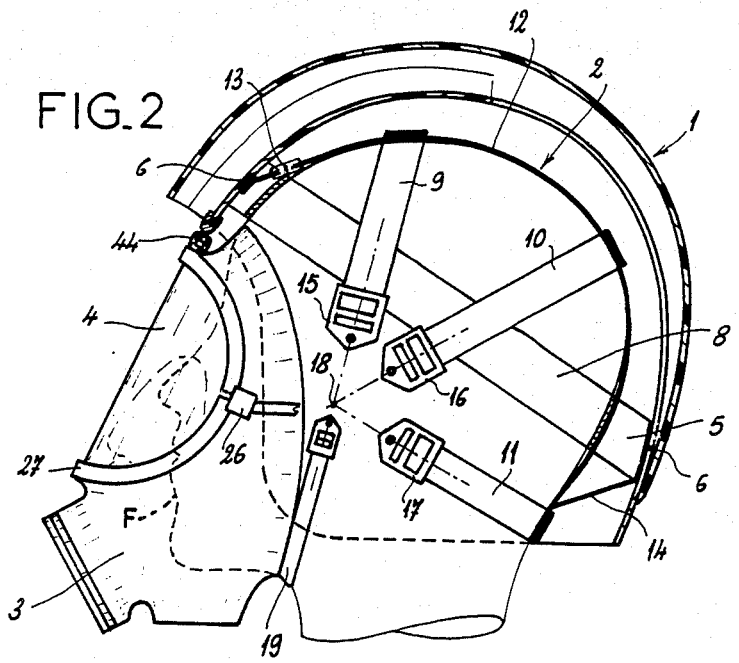
FIG. 2 is a vertical section through the assembly according to the invention taken along a vertical front-to-back symmetry plane.
Figure 3:
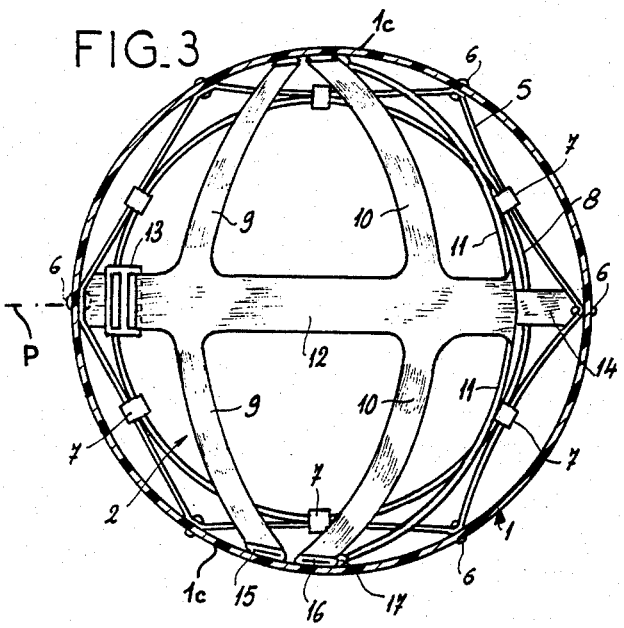
FIG. 3 is a section taken along the plane indicated at III—III in FIG. 1.

As seen in FIGS. 1, 2, 3, and 5 a rigid synthetic-resin helmet shell 1 is provided internally with a strap assembly 2 and is usable with a generally standard respirator mask 3 having a lens 4. The shell 1 forms a face cutout 1*a* that lies in front of the face F of a wearer and a neck cutout 1*b* through which passes the neck of the wearer. It is symmetrical about an upright symmetry plane P (FIG. 3) and has a pair of sides 1*c* (FIGS. 3 and 5) that overlie the ears of the wearer.

The strap assembly 2 comprises an outer annular strap 5 bisected by the plane P and lying generally in a plane itself inclined upward and forward, that is toward the face cutout 1*a*. It is secured at six equispaced points by rivets 6 to the shell 1 and is in turn secured intermediate these rivets 6 at clips 7 to an inner annular band 8 that engages around the head of the wearer like a headband. One of the clips 7 can be constituted as an adjustable buckle, as in a hard hat or the like, to vary the length of the band 8 to accommodate different sizes of heads.

In addition the strap assembly 2 has front, center, and rear radial straps 9, 10, and 11 extending downward from a common longitudinal strap 12 that lies in the plane P toward points 18 lying approximately at the ears of the wearer. The longitudinal strap 12 has a clip or buckle 13 that allows its length to be adjusted, and the ends of the straps 9, 10, and 11 fit into respective buckles 15, 16, and 17 that are also adjustable and that are riveted to the respective sides 1*c* of the shell offset from the point 18. Thus earphones or hearing holes can be provided at these points 18. A tether strap 14 extends up from the center of the rear strap 11 to the middle of the rear of the shell 1 to facilitate donning and taking off the helmet A chin strap 19 having ends also extending toward and attached adjacent the point 18 by appropriate adjustable clips or buckles passes under the jaw of the wearer.

Thus it is possible to adjust the straps 9 and 10 to set the vertical position of the shell 1 on the head of the wearer. Adjustment of the straps 10 and 11 can adjust its front-to-back position. Once properly adjusted for the wearer, the helmet can be donned and removed easily, will sit in the same position on his or her head each time, and will be solidly enough mounted that it will not get knocket off easily.

Figure 4:
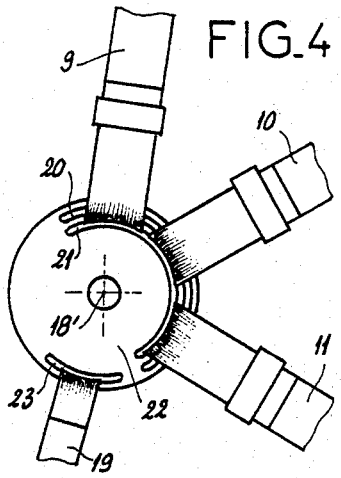
FIG. 4 is a large-scale view of a variation on the strap assembly shown in FIG. 2.

It is also possible as shown in FIG. 4 to anchor the straps 9, 10, 11, and 19 all on a single buckle disk 22 having self-binding slots 20 and 21 for the straps 9, 10, and 11 and another such arcuate slot 23 for the strap 19.

Figure 5:
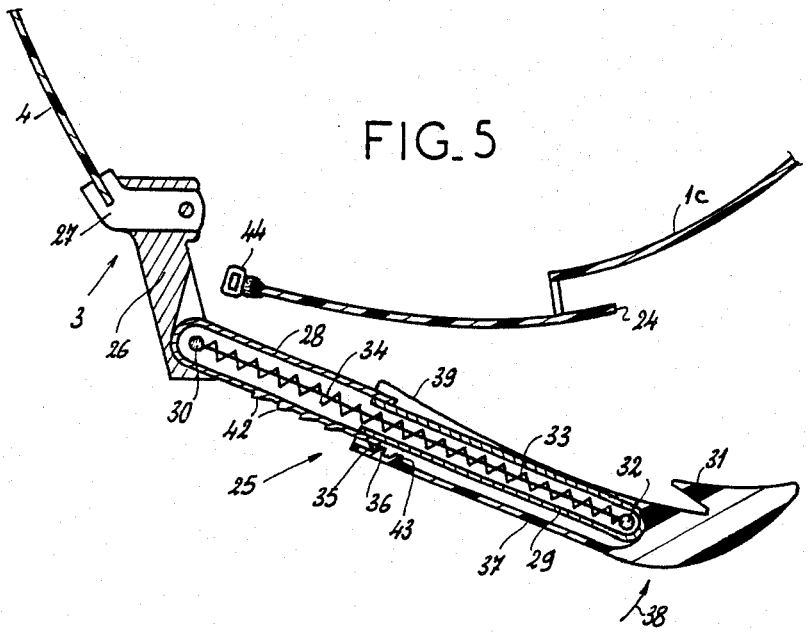
FIG. 5 is a large-scale sectional view taken along line V—V of FIG. 1 of a detail of the instant invention in the open position.

The mask 3 is held in place on the face F by means of two identical hook elements or arms 25 shown in more detail in FIG. 5 and that can engage over integral anchor elements 24 formed on the sides 1*c* of the shell 1 at the locations 18. Each arm 25 is pivoted about a vertical axle pin 30 at its front end on a rigid fitting 26 secured in turn to the rigid frame 27 surrounding the lens 4. The arm 25 is formed by a tubular front part 28 pivoted on the axis pin 30 and a rear part 29 surrounding and telescoping with it and carrying a vertical pivot pin 32 for a hook part 31. A tension spring 33 is hooked at its front end on the pivot pin 30 and at its rear end on the pin 32 to pull the two parts 28 and 29 toward each other, and a flexible but inextensible cable 34 is also conencted between these two pins 30 and 32 to prevent them from pulling too far apart relative to each other.

The front part 28 has on the outer side of its rear end a tooth 35 that can engage in front of a tooth 36 formed on the inner face of the outer side 37 of the hook part 31. The hook part 31 can thus be pulled back away from the mask 3 as shown in FIG. 5 until the tooth 35 engages in front of the tooth 36 and thus prevents the two parts 28 and 29 from movinmg back together toward each other under the force of the spring 33, leaving them in a so-called cocked position.

Figure 6:
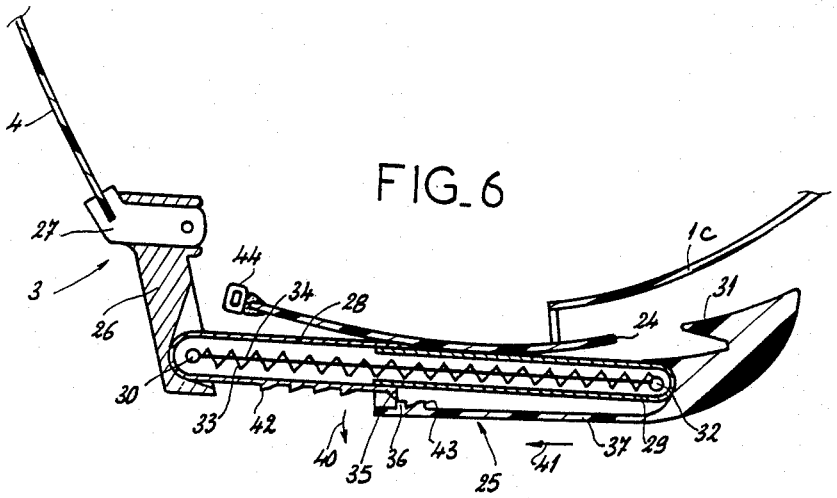
FIGS. 6 and 7 are views like FIG. 5 but showing the detail while closing and in the fully closed position, respectively.

To don the mask 3 once the helmet is securely in place on the head, the user first pulls the two hook arms 25 into the cocked position, and then fits the mask 3 to his or her face, the soft skirt of the mask 3 making an airtight seal. Then as shown in FIGS. 5 and 6 the arms 25 are pivoted about the axis 30 as indicated by arrow 38 until they reach the position shown in Fig. 6, in which position a front inner end 39 (see FIG. 7) of the hook part 31 engages the side 1*c* in front of the anchor 24 and pivots the hook part 31 about the axis 32 as indicated by arrow 40.

Figure 7:
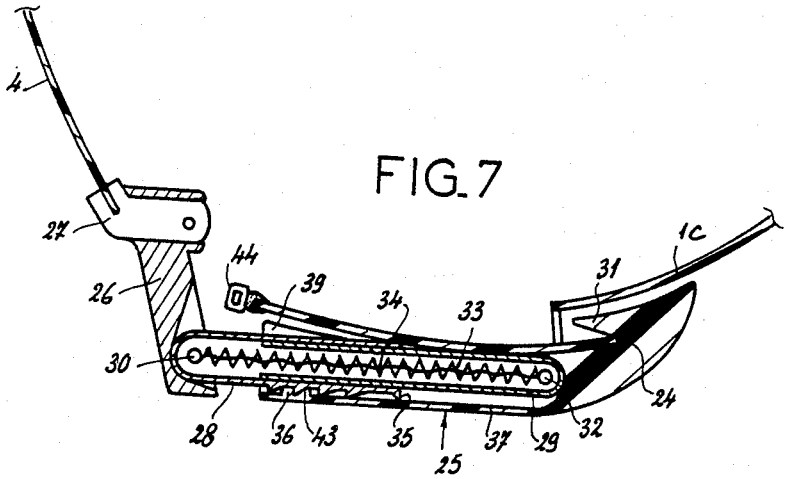

This action disengages the teeth 35 and 36 from each other, causing the rear part 29 and hook part 31 to snap forward under the force of the spring 33 as indicated by arrow 41 until the hook part 31 engages over the anchor 24, as shown in FIG. 7.

The outer face of each front part 28 is formed with a row of sawteeth 42 with their perpendicular flanks directed forward and the inner side 37 of the hook part is formed with an opposite sawtooth 43 that can engage therewith, locking the two elements 28 and 29 so they cannot pull apart.

The mask 3 is removed by pulling out the front part of each hook 31 to disengage the teeth 42 and 43, thereby allowing the hooks 31 to be pulled back off the anchors 24. Thus the mask 3 cannot be knocked or pulled off accidentally, and indeed can only be removed readily by a person familiar with its operation.

The shell 1 is provided around the face cutout 1*a* with a tubular foam-rubber seal 44 that bears against the rigid frame 27 of the mask 3, offering a second barrier of protection for the wearer. Once the helmet is properly adjusted, the mask 3 will fit perfectly on the wearer, and can be donned in seconds.

Figure 8:
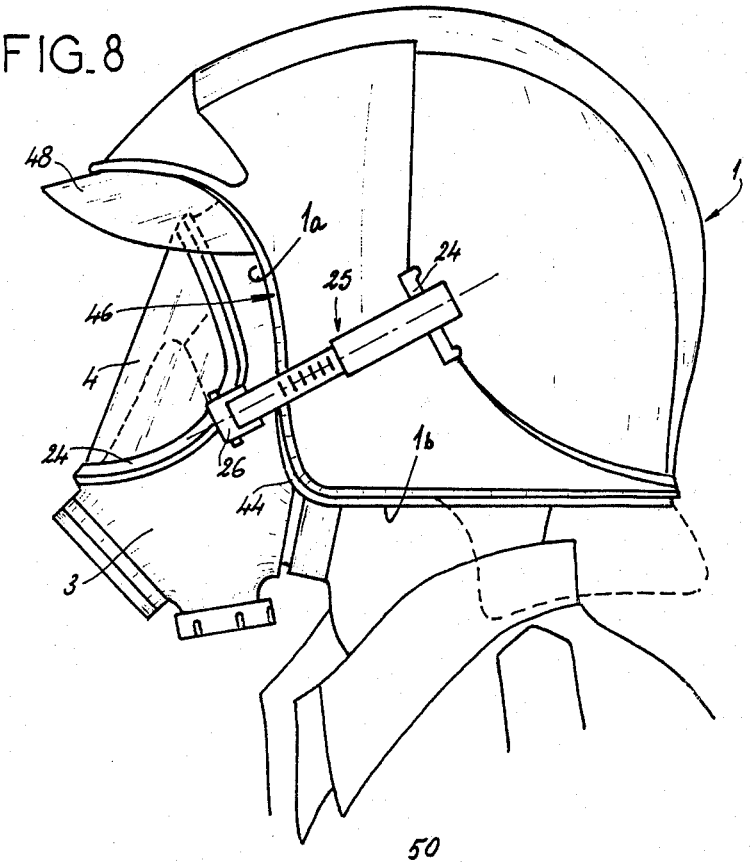
FIGS. 8 and 9 are views corresponding to FIGS. 1 and 2 but of another assembly according to this invention.
Figure 9:
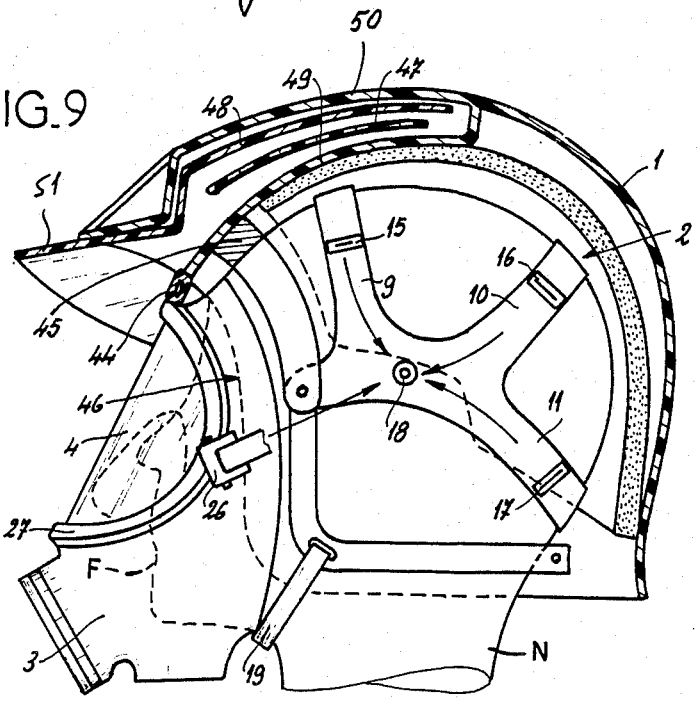

The arrangement of FIGS. 8 and 9 is similar to that of FIGS. 1 through 7, with like reference numerals referring to functionally identical structure. Here the arms 25 extend at an angle and the anchors 24 are secured in place by fasteners. In addition the straps 1 through 11 are integrated into a single piece and are secured in place by a rivet at the point 18.

The shell 1 is provide at the forehead of the wearer with a bumper 45 so as to ensure that the face F of the wearer, regardless of the size of his or her head, will always be a predetermined spacing behind the face cutout. This facilitates fitting of the face mask 3.

In addition the shell 1 is double-walled at least in the front region, having an inner wall 49 and an outer wall 50 defining a pocket, and is provided with an inner lens 47 and an outer shield 48. The lens 47 may be tinted for sun protection and can be pivoted from the illustrated up position to a down in front of the upper portion of the face cutout 1*a*. The shield 48 lies in front of the lens 47, is transparent, and is substantially larger than the lens 47. It is formed at its front end with a visor 51 that in the unillustrated down position protects the throat of the wearer. Both the shield lens 47 and shield 48 are of a durable synthetic resin and can be used together or separately, whether or not the mask 3 is being used also. When not in use they are safely out of the way inside the helmet shell 1.

The helmet assembly according to this invention can be adjusted to fit a wide range of sizes, and allows even the wearer with the largest or smallest head to simultaneously wear a respirator or air-supply mask at the same time. This mask secures rapidly and easily to the helmet while making a good seal with the face of the wearer.

I claim:

1. In combination, a helmet comprising a rigid double-walled shell having right and left sides and formed therebetween with a forwardly open face cutout and therebelow with a downwardly open neck opening;

means inside the shell for supporting same on the head of a wearer with the face cutout in front of the wearer's face and the neck opening around the wearer's neck;

respective right and left backwardly directed anchor elements fixed on the right and left sides of the shell outside the shell, the helmet being generally symmetrical about a vertical symmetry plane between the sides and bisecting the cutout and opening; and an at least semitransparent lens pivotal on the shell between a down position in front of the upper portion of the face cutout and an up position lying above the face cutout between the walls of the shell; and a respirator comprising a mask engageable through the face cutout snugly with the face of the wearer of the helmet;

respective right and left hooks engageable with the respective anchor elements and each including a front part pivoted on the mask, a rear part telescoping with the front part, a forwardly hooked part carried on the rear part and engageable behind the respective anchor element when the mask is engaged through the face cutout with the face of the helmet wearer; and respective springs connected between the rear parts and the respective front parts, the springs being tensioned to telescope the rear parts forward into the respective front parts and thereby pull the mask back into the face cutout of the helmet and against the face of the user when the hook parts are engaged over the respective anchor elements and the mask is engaged through the face cutout with the helmet wearer, the respirator being substantially only connected to the helmet by the hooks.

2. The respirator and helmet combination defined in claim 1 wherein the anchor elements are unitary with the respective sides of the shell.

3. The respirator and helmet combination defined in claim 1 wherein each hook further comprises latch means for holding the respective front and rear parts apart against the force of the respective spring except when the respective hook part is engaged over the respective anchor piece.

4. The respirator and helmet combination defined in claim 3 wherein the hook part and front part carry respective interfitting latch formations constituting the latch means and the hook part is pivotal on the rear part between one position with the formations interfitting and blocking relative displacement of the parts and another position with the formations out of contact with each other.

5. The respirator and helmet combination defined in claim 4 wherein in each hook one of the respective front and hook parts is formed with a row of sawteeth engageable with the formation of the other of the respective front and hook parts to block displacement of same away from each other in the other position of the respective hook part.

6. The respirator and helmet combination defined in claim 1 wherein each hook is provided with a flexible but inextensible element connected between the respective front and rear parts and limiting displacement of same away from each other.

7. The respirator and helmet combination defined in claim 1 wherein the helmet further comprises a transparent face shield pivotal on the shell between a down position in front of the entire face cutout and an up position lying above the face cutout between the walls of the shell.

8. The respirator and helmet combination defined in claim 7 wherein the shield is formed with a visor that projects forward from above the face cutout in the up position of the shield.

* * * * *